US008961771B2

(12) United States Patent
Baskaran et al.

(10) Patent No.: US 8,961,771 B2
(45) **Date of Patent: *Feb. 24, 2015**

(54) ELECTROLYTIC PROCESS USING CATION PERMEABLE BARRIER

(75) Inventors: Rajesh Baskaran, Kalispell, MT (US); Robert W. Batz, Jr., Kalispell, MT (US); Bioh Kim, Milford, CT (US); Tom L. Ritzdorf, Bigfork, MT (US); John L. Klocke, Kalispell, MT (US); Kyle M. Hanson, Kalispell, MT (US)

(73) Assignee: APPLIED Materials, Inc., Santa Clara, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/559,494

(22) Filed: Jul. 26, 2012

(65) Prior Publication Data

US 2012/0292194 A1 Nov. 22, 2012

Related U.S. Application Data

(60) Continuation of application No. 11/414,145, filed on Apr. 28, 2006, now Pat. No. 8,236,159, which is a continuation-in-part of application No. 10/861,899, filed on Jun. 3, 2004, now Pat. No. 7,585,398, which is (Continued)

(51) Int. Cl.
*C25D 7/12* (2006.01)
*C25D 17/00* (2006.01)
(Continued)

(52) U.S. Cl.
CPC ..... *C25D 21/12* (2013.01); *C25D 17/02* (2013.01); *C25D 17/002* (2013.01); *C25D 7/12* (2013.01)
USPC ..... 205/157; 205/98; 205/295; 205/296; 205/673; 205/674; 205/640

(58) Field of Classification Search
USPC ..... 205/98, 157, 295, 296, 673, 674, 640
See application file for complete search history.

(56) References Cited

U.S. PATENT DOCUMENTS 4,110,176 A 8/1978 Creutz
4,163,084 A 7/1979 Tsai
(Continued)

FOREIGN PATENT DOCUMENTS

WO 99/53119 A1 10/1999
WO 00/05747 A2 2/2000
WO 2004/108995 A1 12/2004

OTHER PUBLICATIONS

Baskaran, R., and T. Ritzdorf, "Direct on Barrier Copper Deposition," Proceedings of Advanced Metallization Conference, San Diego, California, Oct. 20, 2004, 12 pages.
(Continued)

*Primary Examiner* — Harry D. Wilkins, III
*Assistant Examiner* — Zulmariam Mendez
(74) *Attorney, Agent, or Firm* — Christensen O'Connor Johnson Kindness PLLC

(57) ABSTRACT

Processes and systems for electrolytically processing a microfeature workpiece with a first processing fluid and an anode are described. Microfeature workpieces are electrolytically processed using a first processing fluid, an anode, a second processing fluid, and a cation permeable barrier layer. The cation permeable barrier layer separates the first processing fluid from the second processing fluid while allowing certain cationic species to transfer between the two fluids. The described processes produce deposits over repeated plating cycles that exhibit deposit properties (e.g., resistivity) within desired ranges.

15 Claims, 9 Drawing Sheets

Related U.S. Application Data a continuation-in-part of application No. 09/872,151, filed on May 31, 2001, now Pat. No. 7,264,698, which is a continuation-in-part of application No. 09/804,697, filed on Mar. 12, 2001, now Pat. No. 6,660,137, which is a continuation of application No. PCT/US00/10120, filed on Apr. 13, 2000, said application No. 11/414,145 is a continuation-in-part of application No. 10/729,357, filed on Dec. 5, 2003, now Pat. No. 7,351,315, and a continuation-in-part of application No. 10/729,349, filed on Dec. 5, 2003, now Pat. No. 7,351,314, and a continuation-in-part of application No. 10/059,907, filed on Jan. 29, 2002, now abandoned, which is a division of application No. 09/531,828, filed on Mar. 21, 2000, now Pat. No. 6,368,475.

(60) Provisional application No. 60/129,055, filed on Apr. 13, 1999.

(51) Int. Cl.
*C25D 17/02* (2006.01)
*C25D 21/12* (2006.01)

(56) References Cited

U.S. PATENT DOCUMENTS

| | | | |
|---|---|---|---|
| 4,323,435 | A | 4/1982 | Carlin |
| 4,574,095 | A | 3/1986 | Baum |
| 4,778,572 | A | 10/1988 | Brown |
| 4,933,052 | A | 6/1990 | O'Brien |
| 4,950,368 | A | 8/1990 | Weinberg |
| 4,975,159 | A | 12/1990 | Dahms |
| 5,009,714 | A | 4/1991 | Arrington |
| 5,082,538 | A | 1/1992 | DeRespiris |
| 5,114,544 | A | 5/1992 | Forsyth |
| 5,151,168 | A | 9/1992 | Gilton |
| 5,162,079 | A | 11/1992 | Brown |
| 5,164,332 | A | 11/1992 | Kumar |
| 5,215,631 | A | 6/1993 | Westfall |
| 5,243,222 | A | 9/1993 | Harper |
| 5,256,274 | A | 10/1993 | Poris |
| 5,358,907 | A | 10/1994 | Wong |
| 5,478,445 | A | 12/1995 | Barker |
| 5,533,971 | A | 7/1996 | Phipps |
| 5,800,858 | A | 9/1998 | Bickford |
| 5,882,498 | A | 3/1999 | Dubin |
| 5,883,762 | A | 3/1999 | Calhoun |
| 5,891,513 | A | 4/1999 | Dubin |
| 6,197,181 | B1 | 3/2001 | Chen |
| 6,227,263 | B1 | 5/2001 | Kust |
| 6,277,263 | B1 | 8/2001 | Chen |
| 6,290,833 | B1 | 9/2001 | Chen |
| 6,300,244 | B1 | 10/2001 | Itabashi |
| 6,319,387 | B1 | 11/2001 | Krishnamoorthy |
| 6,368,475 | B1 | 4/2002 | Hanson |
| 6,368,966 | B1 | 4/2002 | Krishnamoorthy |
| 6,413,864 | B1 | 7/2002 | Pyo |
| 6,472,023 | B1 | 10/2002 | Wu |
| 6,485,542 | B2 | 11/2002 | Shindo |
| 6,494,219 | B1 | 12/2002 | Nayak |
| 6,515,368 | B1 | 2/2003 | Lopatin |
| 6,527,920 | B1 | 3/2003 | Mayer |
| 6,531,046 | B2 | 3/2003 | Morrissey |
| 6,565,729 | B2 | 5/2003 | Chen |
| 6,602,394 | B1 | 8/2003 | Hillebrand |
| 6,660,137 | B2 | 12/2003 | Wilson |
| 6,755,960 | B1 | 6/2004 | Frischauf |
| 6,811,675 | B2 | 11/2004 | Chen |
| 7,387,964 | B2 | 6/2008 | So |
| 2002/0032499 | A1 | 3/2002 | Wilson |
| 2002/0130046 | A1 | 9/2002 | Cheung |
| 2003/0127337 | A1 | 7/2003 | Hanson |
| 2004/0000491 | A1 | 1/2004 | Kovarsky |
| 2004/0016636 | A1 | 1/2004 | Yang |
| 2004/0065543 | A1 | 4/2004 | Kovarsky |
| 2004/0072419 | A1 | 4/2004 | Baskaran |
| 2004/0118694 | A1 | 6/2004 | Yang |
| 2005/0006245 | A1 | 1/2005 | Sun |
| 2005/0081744 | A1 | 4/2005 | Klocke |
| 2005/0087439 | A1 | 4/2005 | Hanson |
| 2005/0121317 | A1 | 6/2005 | Klocke |
| 2005/0121326 | A1 | 6/2005 | Klocke |
| 2005/0189231 | A1 | 9/2005 | Capper |
| 2006/0096867 | A1 | 5/2006 | Bokisa |
| 2006/0260952 | A1 | 11/2006 | Mazur |

OTHER PUBLICATIONS

Beaudry, C.L, and J.O. Dukovic, "Faraday in the Fab: A Look at Copper Plating Equipment for On-Chip Wiring," The Electrochemical Society Interface, Winter 2004, pp. 40-44.

Sun, Z.-W., et al., "Direct Plating of Cu on Ru: Nucleation Kinetics and Gap Fill Chemistry," Proceedings of Advanced Metallization Conference, San Diego, California, Oct. 19-21, 2004, pp. 1-16.

Office Action dated Sep. 21, 2007, from U.S. Appl. No. 11/414,535, filed Apr. 28, 2006, 25 pages.

Office Action mailed Nov. 12, 2009, from U.S. Appl. No. 11/416,659, filed May 3, 2006, 8 pages.

Response dated Dec. 11, 2009, to Office Action mailed Nov. 12, 2009, from U.S. Appl. No. 11/416,659, filed May 3, 2006, 10 pages.

Office Action mailed Jan. 12, 2010, from U.S. Appl. No. 11/416,659, filed May 3, 2006, 2 pages.

Response dated Feb. 12, 2010, to Office Action mailed Jan. 12, 2010, from U.S. Appl. No. 11/416,659, filed May 3, 2006, 10 pages.

Office Action mailed Apr. 22, 2010, from U.S. Appl. No. 11/416,659, filed May 3, 2006, 11 pages.

Amendment After Non-Final Rejection, dated Oct. 22, 2010, in response to Office Action mailed Apr. 22, 2010, from U.S. Appl. No. 11/416,659, filed May 3, 2006, 13 pages.

Office Action mailed Nov. 16, 2010, from U.S. Appl. No. 11/416,659, filed May 3, 2006, 11 pages.

Amendment Submitted With RCE, dated May 16, 2011, in response to Office Action mailed Nov. 16, 2010, from U.S. Appl. No. 11/416,659, filed May 3, 2006, 15 pages.

Office Action mailed Jun. 13, 2011, from U.S. Appl. No. 11/416,659, filed May 3, 2006, 11 pages.

Response to Non-Final Rejection, dated Sep. 13, 2011, in response to Office Action mailed Jun. 13, 2011, from U.S. Appl. No. 11/416,659, filed May 3, 2006, 11 pages.

Notice of Allowance mailed Oct. 24, 2011, from U.S. Appl. No. 11/416,659, filed May 3, 2006, 9 pages.

Office Action mailed Oct. 23, 2012, issued in corresponding U.S. Appl. No. 13/406,387, filed Feb. 27, 2012, 9 pages.

Amendment After Non-Final Rejection filed Feb. 25, 2013, filed in corresponding U.S. Appl. No. 13/406,387, filed Feb. 27, 2012, 12 pages.

Final Office Action mailed Apr. 9, 2013, issued in corresponding U.S. Appl. No. 13/406,387, filed Feb. 27, 2012, 9 pages.

Amendment After Final Action filed Jul. 9, 2013, filed in corresponding U.S. Appl. No. 13/406,387, filed Feb. 27, 2012, 13 pages.

Advisory Action mailed Jul. 19, 2013, issued in corresponding U.S. Appl. No. 13/406,387, filed Feb. 27, 2012, 3 pages.

Office Action mailed Oct. 2, 2013, issued in corresponding U.S. Appl. No. 13/406,387, filed Feb. 27, 2012, 10 pages.

ELECTROLYTIC PROCESS USING CATION PERMEABLE BARRIER

CROSS-REFERENCES TO RELATED APPLICATIONS

This application is a continuation of U.S. patent application Ser. No. 11/414,145, filed Apr. 28, 2006, now issued as U.S. Pat. No. 8,236,159, the disclosure of which is hereby incorporated by reference herein.

FIELD OF THE INVENTION

The present invention relates to electrolytic processing of microfeature workpieces and electrolytic treatment processes that utilize a cation permeable barrier.

BACKGROUND OF THE INVENTION

Microfeature devices, such as semiconductor devices, imagers, displays, thin film heads, micromechanical components, microelectromechanical systems (MEMS), and large through-wafers vias are generally fabricated on and/or in microfeature workpieces using a number of machines that deposit and/or etch materials from the workpieces. Many current microfeature devices require interconnects and other very small, submicron sized features (e.g., 45-250 nanometers) formed by depositing materials into small trenches or holes. One particularly useful process for depositing materials into small trenches and/or vias is electrolytic processing, e.g., electroplating. Typical electrolytic processing techniques include electroplating processes that deposit copper, nickel, lead, gold, silver, tin, platinum, and other materials onto microfeature workpieces and etching processes that remove metals from microfeature workpiece surfaces.

In certain electroplating or etching processes, chelants or complexing agents are used to affect the electric potential at which metal ions are deposited onto or removed from surfaces of microfeature workpieces. Other components that may be present in the processing fluids include accelerators, suppressors, and levelers which can affect the results of the electroplating or electroetching process. Although these types of materials can positively influence the electroplating or electroetching processes, their use is not without drawbacks. For example, it is possible for these components to have an adverse impact on the electrolytic process as a result of reactions or other interactions with electrodes used in the electrolytic process.

Another challenge in depositing metals into narrow, deep trenches or vias is that it is difficult to completely fill the small features without creating voids or other nonuniformities in the deposited metal. For example, when depositing metal into a trench having a critical dimension of 45 nanometers to 250 nanometers, an ultrathin seed layer may be used, but care must be taken to ensure sufficient vacant space in the trench for the subsequently deposited bulk metal. In addition, ultrathin seed layers may be problematic because the quality of the deposited seed layer may not be uniform. For example, ultrathin seed layers may have voids or other nonuniform physical properties that can result in nonuniformities in the material deposited onto the seed layer. Such challenges may be overcome by enhancing the seed layers or forming a seed layer directly on a barrier layer to provide competent seed layers that are well suited for depositing metals into trenches or holes with small critical dimensions. One technique for enhancing the seed layer or forming a seed layer directly on a barrier layer is to electroplate a material using a processing solution with a low conductivity. Such low conductivity processing fluids have relatively low hydrogen ion ($H^+$) concentrations, i.e., relatively high pH. Suitable electrochemical processes for forming competent seed layers using low conductivity processing fluids are disclosed in U.S. Pat. No. 6,197,181, which is herein incorporated by reference.

Electroplating onto seed layers or electroplating materials directly onto barrier layers using low conductivity/high pH processing fluids presents additional challenges. For example, inert anodes are generally required when high pH processing fluids are used because the high pH tends to passivate consumable anodes. Such passivation may produce metal hydroxide particles and/or flakes that can create defects in the microfeatures. Use of inert anodes is not without its drawbacks. The present inventors have observed that when inert anodes are used, the resistivity of the deposited material increases significantly over a relatively small number of plating cycles. One way to combat this increase in the resistivity of the deposited material is to frequently change the processing fluid; however, this solution increases the operating cost of the process.

As a result, there is a need for electrolytic processes for treating microfeature workpieces that reduce adverse impacts created by the presence of complexing agents and/or other additives and also maintain deposit properties, such as resistivity, within desired ranges.

SUMMARY

The embodiments described herein relate to processes for electrolytically processing a microfeature workpiece to deposit or remove materials from surfaces of microfeature workpieces. The processes described herein are capable of producing deposits exhibiting properties, such as resistivity values, within desired ranges over an extended number of plating cycles. The embodiments described herein also relate to processes that reduce the adverse impacts created by the presence of complexing agents and/or other additives in processing fluids used to electrolytically process a microfeature workpiece. In some embodiments, the described processes employ low conductivity/high pH processing fluids without suffering from the drawback of defect formation in the deposited material resulting from the presence of metal hydroxide particles or flakes present in processing fluids in contact with the microfeature workpiece. Processors of microfeature workpieces will find certain processes described herein desirable because the processes produce high yields of acceptable deposits without requiring costly frequent replacement of processing fluids. Reducing adverse impacts created by the presence of complexing agents and/or other additives in the processing fluids may also be considered desirable by users of the electrolytic processes described herein.

In one embodiment, a surface of a microfeature workpiece is contacted with a first processing fluid that includes first processing fluid species, such as a cation, an anion, and a complexing agent. A counter electrode is in contact with a second processing fluid and an electrochemical reaction occurs at the counter electrode. The process effectively prevents movement of non-cationic, e.g., anionic species between the first processing fluid and the second processing fluid. In certain embodiments, the first processing fluid can be a low pH processing fluid, the second processing fluid can be a high pH processing fluid, the cation can be a metal ion to be deposited onto the surface of the microfeature workpiece, and the counter electrode can be an inert electrode.

In another embodiment, a surface of a microfeature workpiece is contacted with a first processing fluid that includes a metal ion to be deposited onto the surface of the microfeature workpiece. In addition, the first processing fluid includes a complexing agent and a counter anion to the metal ion. An inert anode is in contact with a second processing fluid, and an oxidizing agent is produced at the inert anode. The process employs a cation permeable barrier between the first processing fluid and the second processing fluid. The cation permeable barrier allows cations, e.g., hydrogen ions, to pass from the first processing fluid to the second processing fluid. In this embodiment, metal ions in the first processing fluid are deposited onto the surface of the microelectronic workpiece. In certain embodiments, the first and second processing fluids can be high pH processing fluids.

In a further embodiment, a surface of a microfeature workpiece is contacted with a first processing fluid that includes a metal ion to be deposited onto a surface of the microelectronic workpiece. In this embodiment, an inert anode is in contact with a second processing fluid that includes a buffer and pH adjustment agent and a cation permeable barrier is located between the first processing fluid and the second processing fluid.

The processes summarized above can be carried out in a system for electrolytically processing a microfeature workpiece. The system includes a chamber that has a processing unit for receiving a first processing fluid and counter electrode unit for receiving a second processing fluid. A counter electrode is located in the counter electrode unit, and a cation permeable barrier is located between the processing unit and the counter electrode unit. The system also includes a source of complexing agent. The chamber further includes a source of metal ion in fluid communication with the processing unit or the counter electrode unit and a source of a pH adjustment agent in fluid communication with the processing unit.

Through the use of processes described above and the system described above, metals such as copper, nickel, lead, gold, silver, tin, platinum, ruthenium, rhodium, iridium, osmium, rhenium, and palladium can be deposited onto surfaces of a microfeature workpiece. Such surfaces can take the form of seed layers or barrier layers.

The process embodiments and systems described above can be used to electroplate materials onto a surface of a microfeature workpiece or used to electroetch or deplate materials from a surface of a microfeature workpiece. When the process is used to electroplate materials, the microfeature workpiece will function as a cathode, and the counter electrode will function as an anode. In contrast, when deplating is carried out, the microfeature workpiece will function as an anode, and the counter electrode will function as a cathode.

Accordingly, in another embodiment, a surface of a microfeature workpiece is contacted with a first processing fluid that includes hydrogen ion and a counter ion to a metal on the surface. A cathode is contacted with a second processing fluid also containing hydrogen ion, and a cation permeable barrier is located between the first processing fluid and the second processing fluid. Chemical species in the second processing fluid are reduced, and an acid is introduced to the first processing fluid to provide hydrogen ions. Hydrogen ions from the first processing fluid are passed through the cation permeable barrier to the second processing fluid. In accordance with this embodiment, metals from the surface of the microfeature workpiece are electrolytically dissolved, i.e., oxidized and deplated.

The process summarized in the previous paragraph can be carried out in a system for electrolytically processing a microfeature workpiece that includes a chamber that has a processing unit for receiving a first processing fluid and a counter electrode unit for receiving a second processing fluid. A cation permeable barrier is positioned between the processing unit and the counter electrode unit. The system further includes a cathode in the counter electrode unit, a source of hydrogen ions in fluid communication with the processing unit, and a source of pH adjustment agent in fluid communication with the counter-electrode unit.

Through the use of the processes and systems described above for removing materials from surfaces of a microfeature workpiece, metals such as copper, nickel, lead, gold, silver, tin, and platinum can be deplated from a microfeature workpiece surface.

In accordance with another embodiment of the present disclosure, a process for electrolytically processing a microfeature workpiece as the working electrode with a first processing fluid and a counter electrode is provided. The process generally includes contacting a surface of the microfeature workpiece with the first processing fluid, the first processing fluid comprising first processing fluid species including at least one metal cation, an anion, and a complexing agent. The process further includes contacting the counter electrode with a second processing fluid, producing an electrochemical reaction at the counter electrode, and electrolytically depositing the metal cation onto the surface of the microfeature workpiece. The process further includes substantially preventing movement of anionic and complexing agent species between the first processing fluid and the second processing fluid.

In accordance with another embodiment of the present disclosure, a process for electrolytically processing a microfeature workpiece as the working electrode with a first processing fluid and a counter electrode is provided. The process generally includes contacting a surface of the microfeature workpiece with the first processing fluid, the first processing fluid comprising first processing fluid species including at least one metal cation, an anion, and at least one organic component selected from the group consisting of accerators, suppressors, and levelers. The process further includes contacting the counter electrode with a second processing fluid, producing an electrochemical reaction at the counter electrode, and electrolytically depositing the metal cation onto the surface of the microfeature workpiece. The process further includes providing a cation exchange membrane to substantially prevent movement of anionic species and the at least one organic component between the first processing fluid and the second processing fluid.

In accordance with yet another embodiment of the present disclosure, a process for electrolytically processing a microfeature workpiece as the working electrode with a first processing fluid and a counter electrode is provided. The process includes contacting a surface of the microfeature workpiece with the first processing fluid, the first processing fluid comprising first processing fluid species including a metal cation, an anion, and a complexing agent. The process further includes contacting the counter electrode with a second processing fluid, producing an electrochemical reaction at the counter electrode, and electrolytically depositing the metal cation onto the surface of the microfeature workpiece. The process further includes providing a cation permeable barrier between the first processing fluid and the second processing fluid to substantially prevent the movement of anionic and complexing agent species between the first processing fluid and the second processing fluid, wherein the cation permeable barrier is oriented in a substantially horizontal.

BRIEF DESCRIPTION OF THE DRAWINGS

The foregoing aspects and many of the attendant advantages of the processes described herein will become more readily appreciated as the same become better understood by reference to the following detailed description, when taken in conjunction with the accompanying drawings, wherein.

DETAILED DESCRIPTION

As used herein, the terms "microfeature workpiece" or "workpiece" refer to substrates on and/or in which micro devices are formed. Such substrates include semiconductive substrates (e.g., silicon wafers and gallium arsenide wafers), nonconductive substrates (e.g., ceramic or glass substrates), and conductive substrates (e.g., doped wafers). Examples of micro devices include microelectronic circuits or components, micromechanical devices, microelectromechanical devices, micro optics, thin film recording heads, data storage elements, microfluidic devices, and other small scale devices.

In the description that follows regarding electroplating a metal onto a microfeature workpiece, specific reference is made to copper as an example of a metal ion that can be electroplated onto a microfeature workpiece. The reference to copper ions is for exemplary purposes, and it should be understood that the following description is not limited to copper ions. Examples of other metal ions useful in the processes described herein include gold ions, tin ions, silver ions, platinum ions, lead ions, cobalt ions, zinc ions, nickel ions, ruthenium ions, rhodium ions, iridium ions, osmium ions, rhenium ions, and palladium ions.

In the description that follows regarding electroplating more than one metal onto a microfeature workpiece, specific reference is made to a tin-silver solder system as an example of metal ions that can be electroplated onto a microfeature workpiece to form a composite deposit. The reference to deposition of a tin-silver solder is for exemplary purposes, and it should be understood that the description is not limited to tin and silver ions.

With respect to the description that follows regarding deplating a metal from a microfeature workpiece, specific reference is made to copper as an example of a metal ion that can be deplated from a microfeature workpiece. The reference to copper is for exemplary purposes, and it should be understood that the description regarding deplating are not limited to the removal of copper. Examples of other metals that can be removed from a microfeature workpiece in accordance with embodiments described herein include gold ions, tin ions, silver ions, platinum ions, lead ions, cobalt ions, zinc ions, nickel ions, ruthenium ions, rhodium ions, iridium ions, osmium ions, rhenium ions, and palladium ions.

Figure 1:
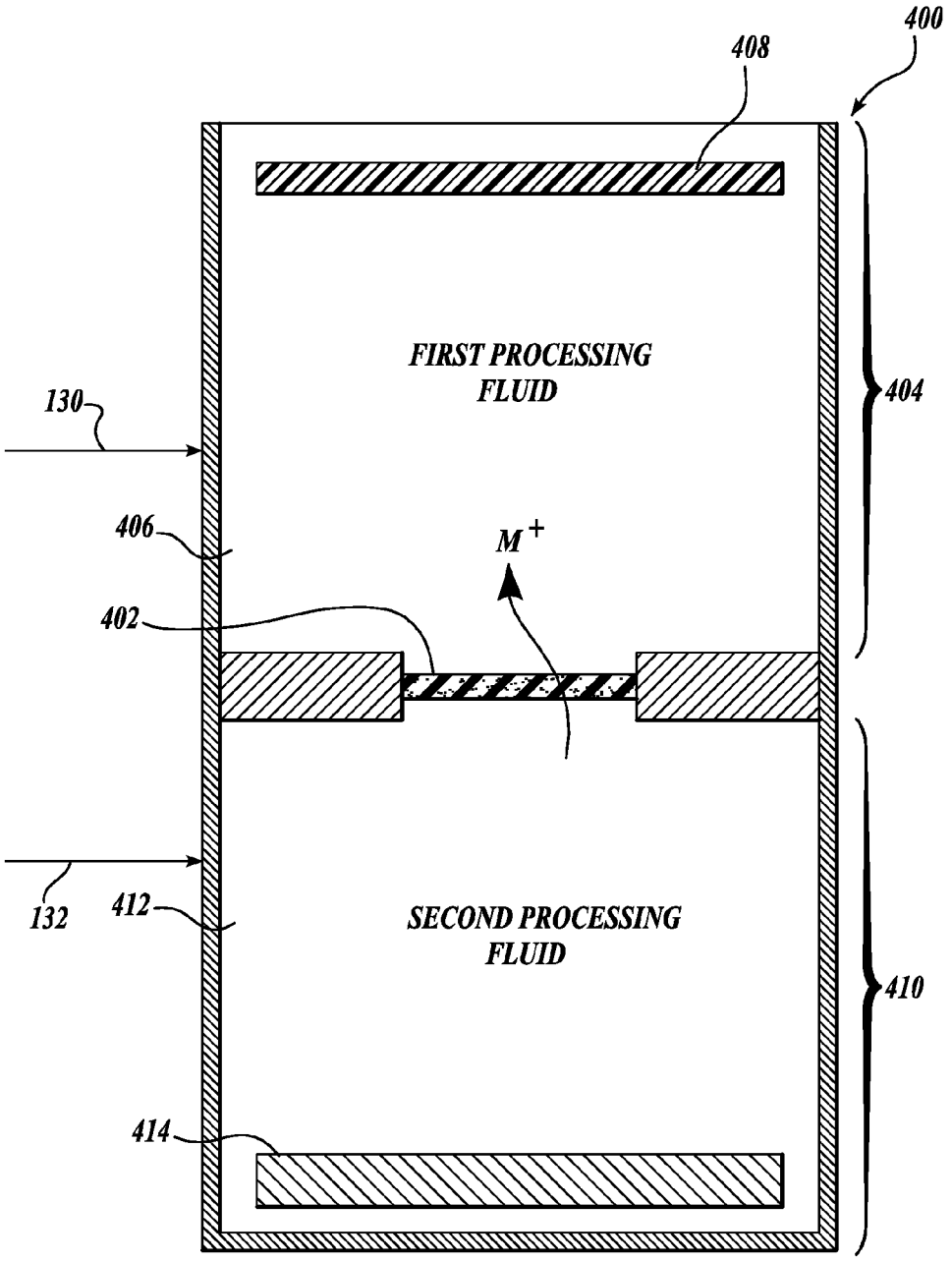
FIG. 1 is a schematic illustration of a reactor for carrying out processes described herein.

Processes described herein can be carried out in an electroplating or deplating reactor, such as the one described below with reference to FIG. 1. Referring to FIG. 1, electrochemical deposition chamber 400 includes an upper processing unit 404 containing a first processing fluid 406 (e.g., a catholyte in an electroplating process or an anolyte in a deplating process) and a counter electrode unit 410 below the processing unit 404 that contains a second processing fluid 412 (e.g., anolyte in an electroplating process or a catholyte in a deplating process) which may be different in composition and/or properties from the first processing fluid 406. Processing unit 404 receives a working electrode 408 (e.g., a microfeature workpiece) and delivers first processing fluid 406 to the working electrode 408. Counter electrode unit 410 includes a counter electrode 414 that is in contact with the second processing fluid 412. When copper is to be deposited onto working electrode 408, working electrode 408 is the cathode and counter electrode 414 is the anode. Accordingly, in plating application, first processing fluid 406 is a catholyte, and second processing fluid 412 is an anolyte. The catholyte 406 typically contains components in the form of ionic species such as acid ions and metal ions, as described below in more detail.

In general, the catholyte contains components in the form of ionic species, such as acid ions (e.g., $H^+$), hydroxyl ions, and metal ions, and complexing agent(s) capable of forming a complex with the metal ions. The catholyte may also include organic components, such as accelerators, suppressors, and levelers that improve the results of the electroplating process. In addition, the catholyte may include a pH adjustment agent to affect the pH of the catholyte. The anolyte generally includes ionic species as well, such as acid ions (e.g., $H^+$), hydroxyl ions, and metal ions. The catholyte may also include a pH adjustment agent. Additional details regarding the various components in the catholyte and anolyte are provided below.

When copper is to be deplated from working electrode 408, working electrode 408 is the anode, and counter electrode 414 is the cathode. Accordingly, in deplating applications, the first processing fluid 406 is an anolyte, and the second processing fluid 412 is a catholyte.

Reactor 400 also includes a nonporous cation permeable barrier 402 between first processing fluid 406 and the second processing fluid 412. Nonporous cation permeable barrier 402 allows cations (e.g., $H^+$ and $Cu^{2+}$) to pass through the barrier while inhibiting or substantially preventing non-cationic components, such as organic components (e.g., accelerators, suppressors, and levelers) and anionic components from passing between the first and second processing fluids. By inhibiting or substantially preventing non-cationic components from passing between the first processing fluid 406 and second processing fluid 412, adverse effects on the deposited material resulting from the presence of unwanted non-cationic components, such as unwanted anions or organic bath components, in the first processing fluid 406 can be avoided. As such, nonporous cation permeable barrier 402 separates first processing fluid 406 and second processing fluid 412 such that first processing fluid 406 can have different chemical characteristics and properties than second processing fluid 412. For example, the chemical components of first processing fluid 406 and second processing fluid 412 can be different, the pH of first processing fluid 406 and second processing fluid 412 can be different, and concentrations of components common to both first processing fluid 406 and second processing fluid 412 can be different.

In the following description of a copper electroplating process, for consistency, working electrode 408 will be referred to as the cathode, and counter electrode 414 will be referred to as the anode. Likewise, first processing fluid 406 will be referred to as the catholyte, and second processing fluid 412 will be referred to as the anolyte. When reactor 400 is used to electrolytically process a microfeature workpiece to deposit metal ions thereon, an electric potential is applied between anode 414 and cathode 408. Copper ions in the catholyte are consumed by the deposition of copper ions onto the cathode. Meanwhile, the anode becomes positively charged and attracts negatively charged ions to its surface. For example, hydroxyl ions in the anolyte are attracted to the anode where they react to liberate oxygen and produce water. The foregoing results in a gradient of charge in the anolyte with unbalanced positively charged species in the anolyte solution, and negatively charged species in the catholyte solution. This charge imbalance encourages the transfer of positively charged cations through the cation permeable barrier 402 from anolyte 412 to the catholyte 406. An electrochemical reaction (e.g., losing or gaining electrons) occurs at cathode 408, resulting in metal ions being reduced (i.e., gaining electrons) to metal on surfaces of cathode 408.

Reactor 400 effectively maintains the concentration of metal ions in catholyte 406 during the electroplating process in the following manner. As metal ions are deposited onto the surface of cathode 408, in addition to the metal ions passing from the anolyte 412 to the catholyte 406, additional metal ions can be introduced to catholyte 406 from a source of metal ions 130, which is in fluid communication with processing unit 404. As explained below in more detail, these metal ions can be provided by delivering a metal salt solution to processing unit 404. Processing unit 404 can also be in fluid communication with sources of other components that need replenishment. In a similar fashion, counter electrode unit 410 may be in fluid communication with sources of components that require replenishment. For example, counter electrode unit 410 can be in fluid communication with a source of pH adjustment agent 132. Likewise, both processing unit 404 and electrode unit 410 can include conduits or other structures for removing portions of catholyte 406 from processing unit 404 or portions of anolyte 412 from counter electrode unit 410.

Anode 414 may be a consumable anode or an inert anode. Exemplary consumable anodes and inert anodes are described below in more detail.

Cation permeable barrier 402 provides several advantages by substantially preventing certain anionic species and organic components from migrating between the catholyte and the anolyte. For example, organic components from the catholyte are unable to flow past the anode and decompose into products that may interfere with the plating process. Second, because organic components do not pass from the catholyte to the anolyte, they are consumed at a slower rate so that it is less expensive and easier to control the concentration of organic components in the catholyte. Third, the risk of passivation by reaction of the anode with organic components is reduced or eliminated. In addition, the presence of the cation permeable barrier reduces the chances that metal flakes or small particles resulting from anode passivation (when a consumable anode is used in combination with a high pH, low conductivity, low acid anolyte) reach the workpiece where the flakes or particles may adversely impact the deposited metal. Another benefit of using the cation membrane is that gases generated at the anode are prevented from passing into the catholyte where they may contact with the workpiece surface.

Exemplary chemistries present in processing unit 404 in FIG. 1 and counter electrode unit 410 of FIG. 1 are described below with reference to FIG. 2. It should be understood that by describing chemical reactions that are believed to occur within reactor 400, the processes described herein are not limited to processes wherein these reactions occur.

Figure 2:
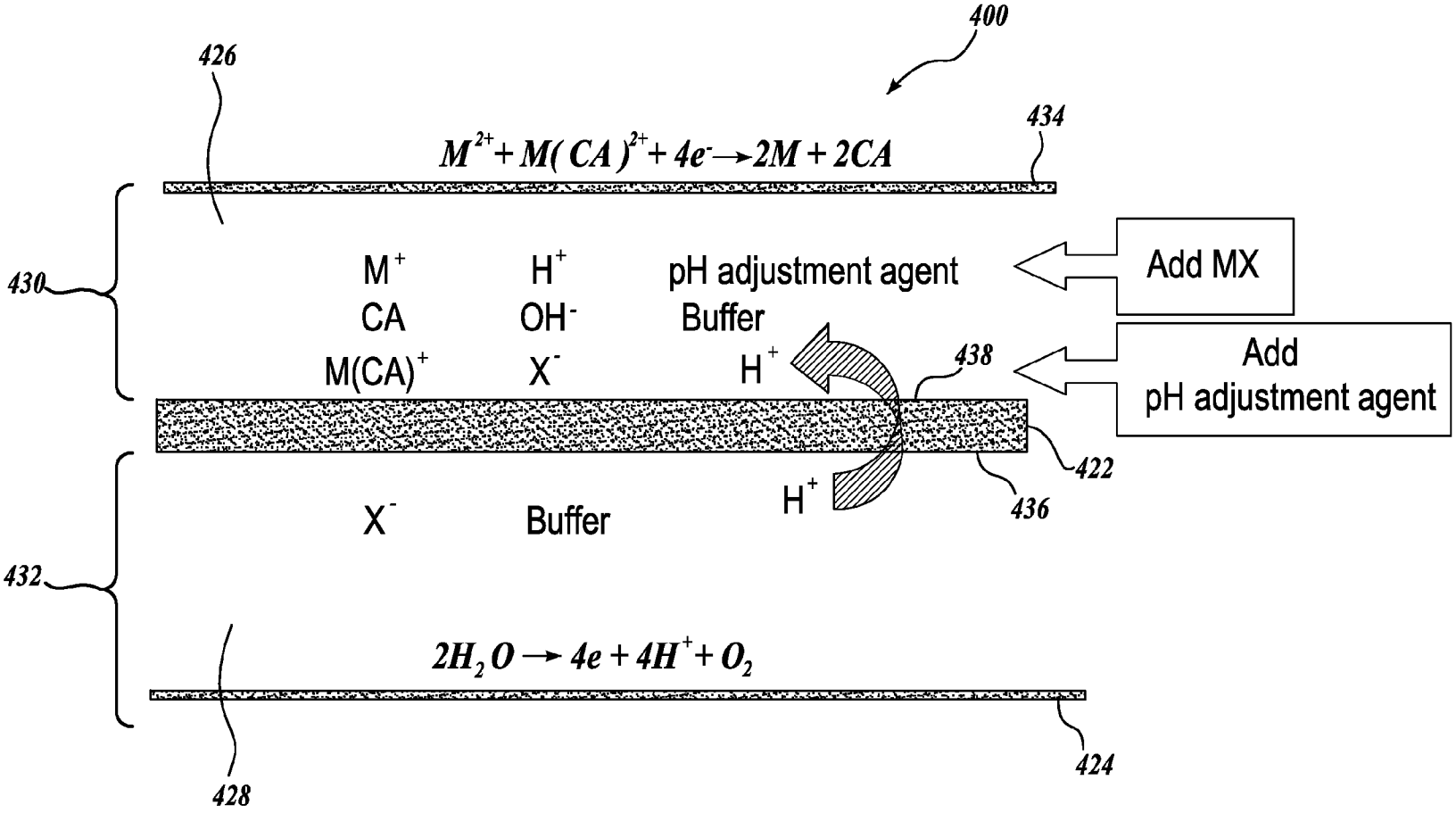
FIG. 2 is a schematic illustration of the chemistry and chemical reactions occurring in one embodiment of the processes for electroplating a metal using an inert anode described herein.

FIG. 2 schematically illustrates an example of the operation of reactor 400 using a cation permeable barrier 422 and an inert anode 424 in combination with a low conductivity/high pH catholyte 426 and a low conductivity/high pH anolyte 428. In the description that follows, catholyte 426 in processing unit 430 contains a metal ion ($M^+$), e.g., copper ion ($Cu^{2+}$), a counter ion ($X^-$) for the metal ion, e.g., sulfate ion ($SO_4^{2-}$), a complexing agent (CA), chelated with the metal ions, a pH buffer such as boric acid ($H_3BO_3$) that dissociates into hydrogen ions ($H^+$) and $H_2BO_3^-$ and a pH adjustment agent, such as tetramethylammonium hydroxide (TMAH) that dissociates into hydroxyl ion ($OH^-$) and $TMA^+$. The specific hydrogen ion concentration and pH of catholyte 426 can be chosen taking into consideration conventional factors such as complexing ability of the complexing agent, buffering capability of the buffer, metal ion concentrations, volatile organics concentrations, deposition potential of the complex at the particular pH, solubility of the catholyte constituents, stability of the catholyte, desired characteristics of the deposits, and diffusion coefficients of the metal ions. Low conductivity, low acid anolyte 428 in electrode unit 432 includes an aqueous solution of an acid, e.g., sulfuric acid that dissociates into hydrogen ion ($H^+$) and sulfate ions ($SO_4^{2-}$). Anolyte 428 may also include a buffer. The hydrogen ion concentration of anolyte 428 is preferably greater than the hydrogen ion concentration of catholyte 426, although this is not required as explained below in more detail. This differential encourages the movement of hydrogen ions from the anolyte 428 to the catholyte 426. In order to account for this increasing hydrogen ion concentration in catholyte 426, pH adjustment agents can be added to catholyte 426. Hydrogen ions from anolyte 428 that migrate across cation permeable barrier 422 to catholyte 426 are replenished in anolyte 428 by the oxidation of water at anode 424, which produces hydrogen ions.

During a plating cycle, an electric potential is applied between cathode 434 and inert anode 424. As metal ions are reduced and electroplated onto cathode 434, hydrogen ions ($H^+$) accumulate in the anolyte 428 near a first surface 436 of cation permeable barrier 422. The resulting electrical charge gradient and concentration gradient causes the positively charged hydrogen ions to move from first surface 436 of cation permeable barrier 422 to the second surface 438 of cation permeable barrier 422 that is in contact with catholyte 426. The transfer of positively charged hydrogen ions from anolyte 428 to catholyte 426 during the plating cycle maintains the charge balance of reactor 400. The electrical charge gradient created by applying an electric potential between cathode 434 and anode 424 also hinders the migration of cations, e.g., metal ions $M^+$ and cations of pH adjustment agent from transferring from catholyte 426 to anolyte 428 through cation permeable barrier 422. In order to avoid the build up of counter ions ($X^-$) of the metal ions and cations of the pH adjustment agent in the catholyte, these ionic and cationic species can be removed from the catholyte 426.

Continuing to refer to FIG. 2, during a plating cycle, as explained above, metal ions in catholyte 426 are reduced at cathode 434 and are deposited as metal. Metal ions that are consumed by the electroplating are replenished by the addition of a solution of metal salt (MX) to catholyte 426.

While operating reactor 400 with the hydrogen ion concentration of anolyte 428 greater than the hydrogen ion concentration of catholyte 426 is preferred in order to promote transfer of hydrogen ions from the anolyte 428 to catholyte 426 through cation permeable membrane 422, it is also possible to operate reactor 400 with the hydrogen ion concentration of the anolyte 428 being less than the hydrogen ion concentration in the catholyte 426. Providing such a hydrogen ion concentration gradient would reduce the driving force promoting transport of hydrogen ions from anolyte 428 to catholyte 426 in favor of the transport of other cationic species that may be present in catholyte 426 in order to provide the necessary charge balance. The transport of such metal cations from catholyte 428 to anolyte 426 would be promoted by the electrical charge gradient between anode 424 and cathode 434. Under such circumstances, it may be necessary to add pH adjustment agents to anolyte 428 in order to maintain the hydrogen ion concentration in anolyte 428 below the hydrogen ion concentration of catholyte 426.

Figure 3:
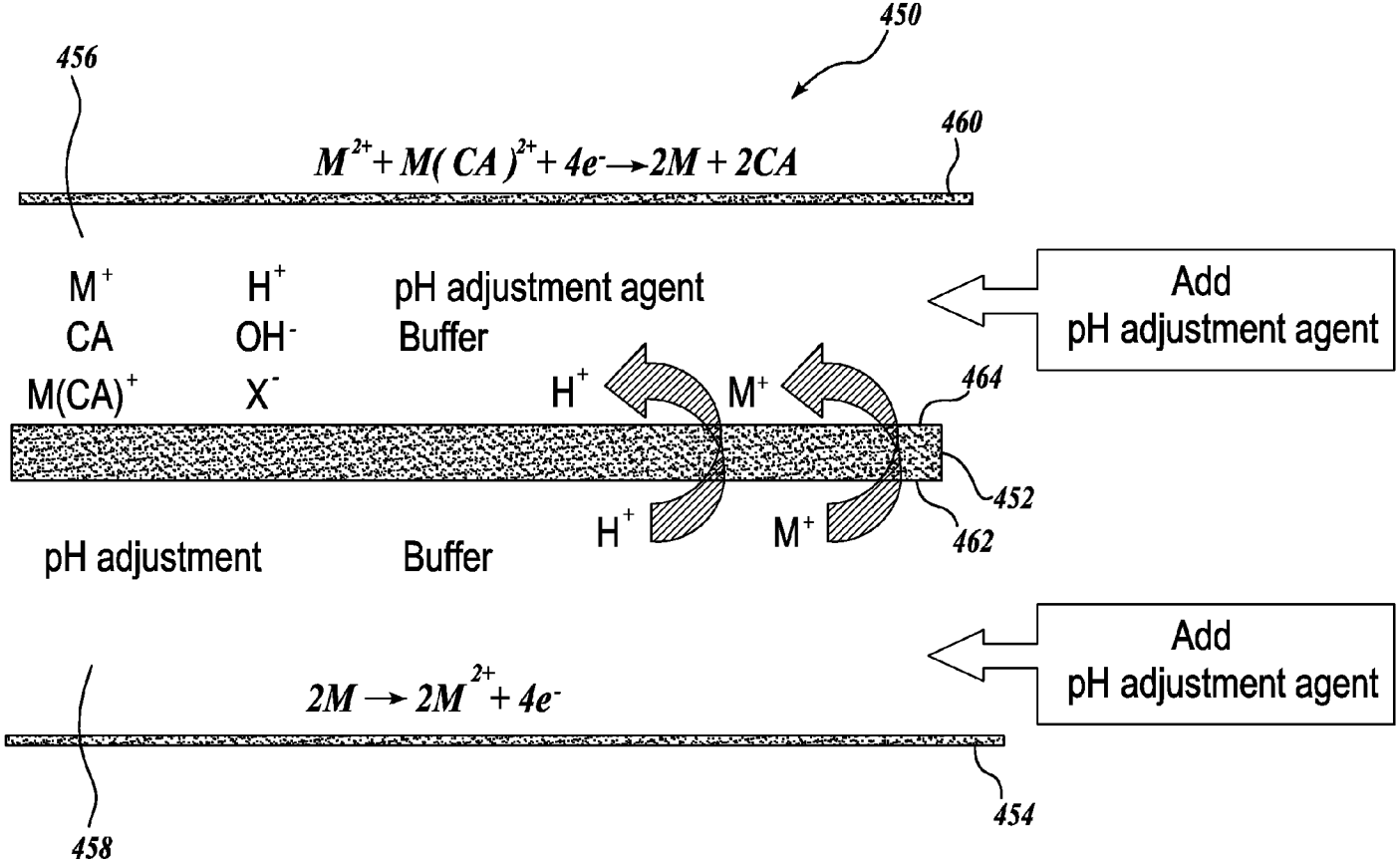
FIG. 3 is a schematic illustration of the chemistry and chemical reactions occurring in another embodiment of the processes for electroplating a metal using a consumable anode described herein.

Metals may also be deposited using a cation permeable barrier and a consumable anode. Referring to FIG. 3, reactor 450, that includes a cation permeable barrier 452, a consumable anode 454, a low conductivity/high pH catholyte 456 and a low conductivity/high pH anolyte 458, is illustrated. For the embodiment of FIG. 3, catholyte 456 can have a composition that is similar to the composition of catholyte 426 described with reference to FIG. 2. Anolyte 458 includes hydrogen ions ($H^+$) and metal ions ($M^+$) from dissolution of consumable anode 454. Anolyte 458 can also include a buffer and dissociation products of pH adjustment agent. It is preferred that positively charged metal ions ($M^+$) transfer across cation permeable barrier 454 as opposed to positively charged hydrogen ions ($H^+$). Accordingly, it is preferred that anolyte 458 be a low acid/high pH anolyte so that there is an absence of a hydrogen ion concentration gradient between catholyte 456 and anolyte 458 that would promote the migration of the hydrogen ions from anolyte 458 to catholyte 456. Furthermore, by inhibiting the transfer of positively charged hydrogen ions from anolyte 458 to catholyte 456, a more constant catholyte pH can be maintained and the need to add a pH adjusting agent to the catholyte can be reduced. As noted above, this simplifies maintenance of the catholyte and helps to maintain the conductivity of the catholyte relatively stable during repeated plating cycles.

Continuing to refer to FIG. 3, during a plating cycle, an electric potential is applied between cathode 460 and anode 454. Metal is oxidized at anode 454 and metal ions ($M^+$) accumulate in the anolyte near a first surface 462 of cation permeable barrier 452. The resulting electrical charge gradient causes the positively charged metal cations ($M^+$) to move from the first surface 462 of cation permeable barrier 452 to the second surface 464 of cation permeable barrier 452. The transfer of positively charged metal ions from anolyte 458 to catholyte 456 during the plating cycle maintains the charge balance of reactor 450. It should be understood that hydrogen ions will also transfer from anolyte 458 through cation exchange membrane 452 to catholyte 456, the magnitude of such transport being dictated in part by the hydrogen ion concentration gradient between anolyte 458 and catholyte 456 as described above. During the plating cycle, metal ions ($M^+$) in catholyte 456 are reduced at cathode 460 and deposited as metal.

Figure 4A:
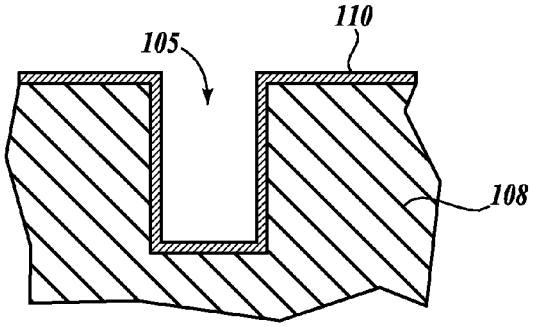
FIGS. 4A-4C are schematic illustrations of one embodiment of the processes described herein for electrolytically treating a seed layer.
Figure 4B:
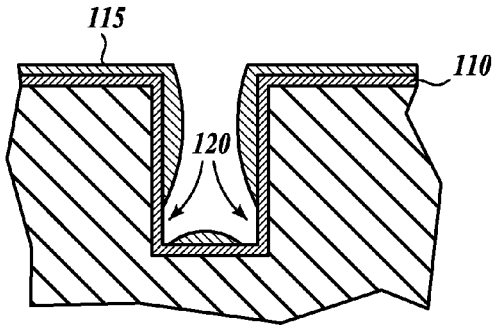
Figure 4C:
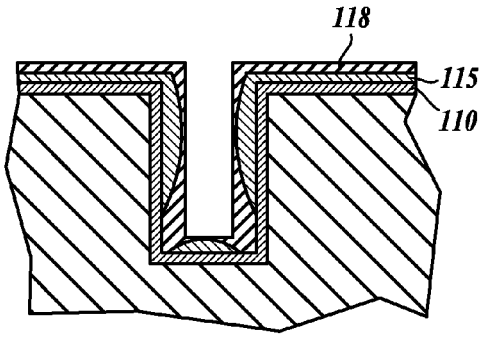

Microfeature workpieces that can be processed using processes described herein can include different structures on their surfaces that can be electrolytically processed to deposit materials thereon. For example, a semiconductor microfeature workpiece can include seed layers or barrier layers. Referring to FIGS. 4A-4C, one sequence of steps for electrolytically processing a seed layer using a process described herein is provided.

Referring to FIG. 4A, a cross-sectional view of a microstructure, such as trench 105 that is to be filled with bulk metallization is illustrated and will be used to describe use of processes described herein to enhance a seed layer. As shown, a thin barrier layer 110, for example, titanium nitride or tantalum nitride, is deposited over the surface of a semiconductor device or, as illustrated in FIG. 4A, over a layer of dielectric 108 such as silicon dioxide. Any known technique such as chemical vapor deposition (CVD) or physical vapor deposition (PVD), can be used to deposit barrier layer 110.

After deposition of barrier layer 110, an ultrathin copper seed layer 115 is deposited on barrier layer 110. The resulting structure is illustrated in FIG. 4B. Seed layer 115 can be formed using a vapor deposition technique also, such as CVD or PVD. Alternatively, seed layer 115 can be formed by direct electroplating onto barrier layer 110. Owing to the small dimensions of trench 105, techniques used to form ultrathin seed layer 115 should be capable of forming the seed layer without closing off small geometry trenches. In order to avoid closing off small geometry trenches, seed layer 115 should be as thin as possible while still providing a suitable substrate upon which to deposit bulk metal.

The use of ultrathin seed layer 115 introduces its own set of drawbacks. For example, ultrathin seed layers may not coat the barrier layer in a uniform manner. For example, voids or non-continuous seed layer regions on the sidewalls of the trenches such as at 120, can be present in ultrathin seed layer 115. The processes described herein can be used to enhance seed layer 115 to fill the void or non-continuous regions 120 found in ultrathin seed layer 115. Referring to FIG. 4C, to achieve this enhancement, the microfeature workpiece is processed as described herein to deposit a further amount of metal 118 onto ultrathin seed layer 115 and/or portions of underlying barrier layer 110 that are exposed at voids or non-continuous portions 120.

Preferably, this seed layer enhancement continues until a sidewall step coverage, i.e., the ratio of seed layer 115 thickness at the bottom sidewall regions to the nominal thickness of seed layer 115 at the exteriorly disposed side of the workpiece, achieves a value of at least 10%. More preferably, the sidewall step coverage is at least about 20%. Preferably, such sidewall step coverage values are present in substantially all of the recessed structures of the microfeature workpiece; however, it will be recognized that certain recessed structures may not reach such sidewall step values.

Figure 5A:
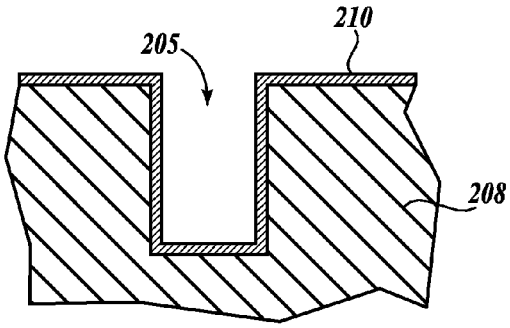
FIGS. 5A and 5B are schematic illustrations of one embodiment of the processes described herein for electrolytically treating a barrier layer.
Figure 5B:
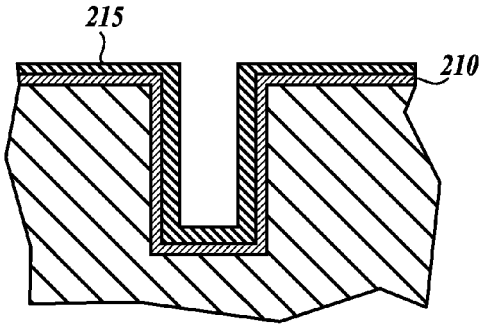

Another type of feature on the surface of a microfeature workpiece that can be electrolytically treated using processes described herein is a barrier layer. Barrier layers are used because of the tendency of certain metals to diffuse into silicon junctions and alter the electrical characteristics of semiconductor devices formed in a substrate. Barrier layers made of materials such as titanium, titanium nitride, tantalum, tantalum nitride, tungsten, and tungsten nitride are often laid over silicon junctions and any intervening layers prior to depositing a layer of metal. Referring to FIG. 5A, a cross-sectional view of a microstructure, such as trench 205 that is to be filled with bulk metallization is illustrated, and will be used to describe the formation of a metal layer directly onto a barrier layer using processes described herein. As illustrated in FIG. 5A, thin barrier layer 210 is deposited over the surface of a semiconductor device or, as illustrated in FIG. 5A, over a layer of dielectric 208, such as silicon dioxide. Barrier layer 210 can be deposited as described above with reference to FIG. 4A using CVD or PVD techniques. After barrier layer 210 is deposited, the microfeature workpiece is processed as described herein to form a metal feature 215 over barrier layer 210. The resulting structure can then be further processed to deposit bulk metal (not shown) to fill the trench 205.

The pH of processing fluids described herein can vary from alkaline to acidic. The low conductivity/high pH processing fluids described herein are distinct from low pH (pH<7) processing fluids such as acidic electroplating baths. The concentration of $H^+$ useful in high pH processing fluids may vary with those providing pHs above 7, preferably above 8 and most preferably above 9 being examples of useful high pH processing fluids.

As noted above, processes described herein are useful to electroplate metals other than copper, for example, gold, silver, platinum, nickel, tin, lead, ruthenium, rhodium, iridium, osmium, rhenium, and palladium. Metal ions useful in the catholyte can be provided from a solution of a metal salt. Exemplary metal salts include gluconates, cyanides, sulfamates, citrates, fluoroborates, pyrophosphates, sulfates, chlorides, sulfides, chlorites, sulfites, nitrates, nitrites, and methane sulfonates. Exemplary concentrations of metal salts in the catholyte used for plating applications range from about 0.03 to about 0.25M.

The ability to electroplate metal ions can be affected by chelating the metal ion with a complexing agent. In the context of the electroplating of copper, copper ions chelated with ethylene diamine complexing agent exhibit a higher deposition potential compared to copper ions that have not been chelated. Complexing agents useful for chelating and forming complexes with metal ions include chemical compounds having at least one part with the chemical structure $COOR_1$—$COHR_2R_3$ where $R_1$ is an organic group or hydrogen covalently bound to the carboxylate group (COO), $R_2$ is either hydrogen or an organic group, and $R_3$ is either hydrogen or an organic group. Specific examples of such type of complexing agents include citric acid and salts thereof, tartaric acid and salts thereof, diethyltartrate, diisopropyltartrate, and dimethyltartrate. Another type of useful complexing agent includes compounds that contain a nitrogen containing chelating group R—$NR_2$—$R_1$, wherein R is any alkyl group, aromatic group, or polymer chain and $R_1$ and $R_2$ are H, alkyl or aryl organic groups. Specific examples of these types of complexing agents include ethylene diamine, ethylene diamine tetraacetic acid and its salts, cyclam, porphrin, bipyridyl, pyrolle, thiophene, and polyamines. In plating embodiments, suitable ratios between the concentration of metal ions and concentrations of complexing agents in the catholyte can range from 1:25 to 25:1; for example, 1:10 to 10:1 or 1:5 to 5:1.

Useful pH adjustment agents include materials capable of adjusting the pH of the first processing fluid and the second processing fluid, for example, to above 7 to about 13, and more specifically, above about 9.0. When ethylene diamine or citric acid are used as a complexing agent for copper ions, a pH of about 9.5 is useful. When ethylene diamine tetraacetic acid is used as a complexing agent for copper ions, a pH of about 12.5 is suitable. Examples of suitable pH adjustment agents include alkaline agents such as potassium hydroxide, ammonium hydroxide, tetramethyl ammonium hydroxide, sodium hydroxide, and other alkaline metal hydroxides. A useful amount and concentration of pH adjustment agents will depend upon the level of pH adjustment desired and other factors, such as the volume of processing fluid and the other components in the processing fluid. Useful pH adjustment agents also include materials capable of adjusting the pH of the first and second processing fluid to below 7.

For acidic processing fluids (low pH, high conductivity, high acid), useful pH adjustment agents include materials capable of adjusting the pH of the first and second processing fluid to below 7. Useful complexing agents for acid processing fluids include pyrophosphate, citric acid, ethylene diamine, ethylene diamine tetraacetic acid, polyimines, and polyamines.

Useful buffers for both alkaline and acidic processing fluids include materials that maintain the pH relatively constant, preferably at a level that facilitates complex formation and desirable complexed species. Boric acid was described above as an example of a suitable buffer. Other useful buffers include sodium acetate/acetic acid and phosphates. Exemplary concentrations of buffer range from about 0.001 to about 0.5M in the catholyte for plating applications. Exemplary buffer concentrations for the anolyte range from about 0.001 to about 1.0M.

The catholyte can include other additives such as those that lower the resistivity of the fluid, e.g., ammonium sulfate; and those that increase the conformality of the deposit, e.g., ethylene glycol. For plating applications, exemplary concentrations of resistivity effecting agents in the catholyte range from about 0.01 to about 0.5M. For conformality affecting agents concentrations ranging from about 0 to 1.0M are exemplary.

The catholyte can also include other additives such as an additive or combination of additives that suppresses the growth of metal nuclei on itself while permitting metal deposition onto the treated barrier layers. Through the use of such additives or additive combinations, nucleation of deposit metal on barrier layers can be promoted over growth of the metal itself. By promoting the nucleation of the metal to be deposited on the barrier layer as opposed to the growth of metal nuclei itself, metal deposition that is conformal (i.e., uniformly lines that feature) and continuous at small dimensions, e.g., thicknesses can be promoted.

Useful cation permeable barriers are generally selective to positively charged ions, e.g., hydrogen ions and metal ions; therefore, hydrogen ions and metal ions may migrate through the useful cation permeable barriers.

Useful cation permeable barriers include nonporous barriers, such as semi-permeable cation exchange membranes. A semi-permeable cation exchange membrane allows cations to pass but not non-cationic species, such as anions. The nonporous feature of the barrier inhibits fluid flow between first processing fluid 406 and second processing fluid 412 within reactor 400 in FIG. 1. Accordingly, an electric potential, a charge imbalance between the processing fluids, and/or differences in the concentrations of substances in the processing fluids can drive cations across a cation permeable barrier. In comparison to porous barriers, nonporous barriers are characterized by having little or no porosity or open space. In a normal electroplating reactor, nonporous barriers generally do not permit fluid flow when the pressure differential across the barrier is less than about 6 psi. Because the nonporous barriers are substantially free of open area, fluid is inhibited from passing through the nonporous barrier. Water, however, may be transported through the nonporous barrier via osmosis and/or electro-osmosis. Osmosis can occur when the molar concentration in the first and second processing fluids are substantially different. Electro-osmosis occurs as water is carried through the nonporous barrier with current-carrying ions in the form of a hydration sphere. When the first and second processing fluids have similar molar concentrations and no electrical current is passed through the processing fluids, fluid flow between the first and second processing fluids via the nonporous barrier is substantially prevented.

A nonporous barrier can be hydrophilic so that bubbles in the processing fluids do not cause portions of the barrier to dry, which reduces conductivity through the barrier. Examples of useful cation permeable barriers include commercially available cation permeable membranes. For example, Tokuyama Corporation manufactures and supplies various hydrocarbon membranes for electrodialysis and related applications under the trade name Neosepta™. Perfluorinated cation membranes are generally available from DuPont Co. as Nafion™ membranes N-117, N-450, or from Asahi Glass company (Japan) under the trade name Flemion™ as Fx-50, F738, and F893 model membranes. Asahi Glass Company also produces a wide range of polystyrene based ion-exchange membranes under the trade name Selemion™, which can be very effective for concentration/desalination of electrolytes and organic removal (cation membranes CMV, CMD, and CMT and anion membranes AMV, AMT, and AMD). There are also companies that manufacture similar ion-exchange membranes (Solvay (France), Sybron Chemical Inc. (USA), Ionics (USA), and FuMA-Tech (Germany), etc.). Bipolar membranes, such as models AQ-BA-06 and AQ-BA-04, for example, are commercially available from Aqualitics (USA) and Asahi Glass Company may also be useful.

In addition to the nonporous barriers described above, cation permeable barrier can also be a porous barrier. Porous barriers include substantial amounts of open area or pores that permit fluid to pass through the porous barrier. Both cationic materials and nonionic materials are capable of passing through a porous barrier; however, passage of certain materials may be limited or restricted if the materials are of a size that allows the porous barrier to inhibit their passage. While useful porous barriers may limit the chemical transport (via diffusion and/or convection) of some materials in the first processing fluid and the second processing fluid, they allow migration of cationic species (enhanced passage of current) during application of electric fields associated with electrolytic processing. In the context of electrolytic processing a useful porous barrier enables migration of cationic species across the porous barrier while substantially limiting diffusion or mixing (i.e., transport across the barrier) of larger organic components and other non-cationic components between the anolyte and catholyte. Thus, porous barriers permit maintaining different chemical compositions for the anolyte and the catholyte. The porous barriers should be chemically compatible with the processing fluids over extended operational time periods. Examples of suitable porous barrier layers include porous glasses (e.g., glass fits made by sintering fine glass powder), porous ceramics (e.g., alumina and zirconia), silica aerogel, organic aerogels (e.g., resorcinol formaldehyde aerogel), and porous polymeric materials, such as expanded Teflon® (Gortex®). Suitable porous ceramics include grade P-6-C available from CoorsTek of Golden, Colo. An example of a porous barrier is a suitable porous plastic, such as Kynar™, a sintered polyethylene or polypropylene. Suitable materials can have a porosity (void faction) of about 25%-85% by volume with average pore sizes ranging from about 0.5 to about 20 micrometers. Such porous plastic materials are available from Poretex Corporation of Fairburn, Ga. These porous plastics may be made from three separate layers of material that include a thin, small pore size material sandwiched between two thicker, larger pore-sized sheets. An example of a product useful for the middle layer having a small pore size is CelGard™ 2400, made by CelGard Corporation, a division of Hoechst, of Charlotte, N.C. The outer layers of the sandwich construction can be a material such as ultra-fine grade sintered polyethylene sheet, available from Poretex Corporation. Porous barrier materials allow fluid flow across themselves in response to the application of pressures normally encountered in an electrochemical treatment process, e.g., pressures normally ranging from about 6 psi and below.

Inert anodes useful in processes described herein are also referred to as non-consumable anodes and/or dimensionally stable anodes and are of the type that when an electric potential is applied between a cathode and an anode in contact with an electrolyte solution, that there is no dissolution of the chemical species of the inert anode. Exemplary materials for inert anodes include platinum, ruthenium, ruthenium oxide, iridium, and other noble metals.

Consumable anodes useful in processes described herein are of the type that when an electric potential is applied between a cathode and an anode in contact with an electrolyte solution, dissolution of the chemical species making up the anode occurs. Exemplary materials for consumable anodes will include those materials that are to be deposited onto the microfeature workpiece, for example, copper, tin, silver, lead, nickel, cobalt, zinc, and the like.

The temperature of the processing fluids can be chosen taking into consideration conventional factors such as complexing ability of the complexing agent, buffering capability of the buffer, metal ion concentration, volatile organics concentration, deposition potential of the complexed metal at the particular pH, solubility of the processing fluid constituents, stability of the processing fluids, desired deposit characteristics, and diffusion coefficients of the metal ions. Generally, temperatures ranging from about 20° C.-35° C. are suitable, although temperatures above or below this range may be useful.

As described above in the context of an electroplating process, oxidation of hydroxyl ions or water at the anode produces oxygen capable of oxidizing components in the catholyte. When a cation permeable barrier is absent, oxidation of components in the electrolyte can also occur directly at the anode. Oxidation of components in an electrolyte is undesirable because it is believed that the oxidized components contribute to variability in the properties (e.g. resistivity) of the metal deposits. Through the use of cation permeable barrier, as described above, transfer of oxygen generated at the anode from the anolyte to the catholyte is minimized and/or prevented, and, thus, such oxygen is not available to oxidize components that are present in the catholyte. As discussed above, one way to address the problem of oxygen generated at the anode oxidizing components in the processing fluid is to frequently replace the processing fluid. Because of the time and cost associated with frequently replacing the processing fluid, the processes described herein provide an attractive alternative by allowing the processing fluids to be used in a large number of plating cycles without replacement. Use of the cation permeable barrier also isolates the anode from non-cationic components in the catholyte, e.g., complexing agent, that may otherwise be oxidized at the anode and adversely affect the ability of the catholyte to deposit features having acceptable properties such as resistivity properties that fall within acceptable ranges.

Another advantage of employing a cation permeable barrier in the processes described herein is that the barrier prevents bubbles from the oxygen or hydrogen gas evolved at the anode from transferring to the catholyte. Bubbles in the catholyte are undesirable because they can cause voids or holes in the deposited features.

In the foregoing descriptions, copper has been used as an example of a metal that can be used to enhance a seed layer or to form a metal feature directly onto a barrier layer. However, it should be understood that the basic principles of the processes described herein and their use for enhancement of an ultrathin metal layer prior to the bulk deposition of additional metal or the direct electroplating of a metal onto a barrier layer can be applied to other metals or alloys as well as deposition for other purposes. For example, gold is commonly used on for thin film head and III-V semiconductor applications. Gold ions can be electroplated using chloride or sulfite as the counter ion. As with copper, the gold and hydrogen ions would migrate across the cationic permeable barrier as described above in the context of copper. Potassium hydroxide could be used as the pH adjustment agent in a gold electroplating embodiment to counteract a drop in pH in the catholyte resulting from migration of hydrogen ions from the anolyte to the catholyte. If needed an agent to counteract the loss of hydrogen ions from the anolyte can be added to the anolyte. As with the copper example described above, in the gold embodiment using an inert anode, gold chloride or gold sulfite, in the form of sodium gold sulfite or potassium gold sulfite could be added to the catholyte to replenish the gold deposited.

As mentioned previously, processes described above are useful for depositing more than one metal ion onto a microfeature workpiece surface. For example, processes described above are useful for depositing multi-component solders such as tin-silver solders. Other types of multi-component metal systems that can be deposited using processes described above include tin-copper, tin-silver-copper, lead-tin, nickel-iron, and tin-copper-antimony. Unlike certain copper features that are formed on the surfaces of microfeature workpieces, solder features tend to be used in packaging applications and are thus large compared to copper microfeatures. Because of their larger size, e.g., 10-200 microns, solder features are more susceptible to the presence of bubbles in processing fluids that can become entrapped and affect the quality of the solder deposits. A tin-silver solder system is an example of plating of a metal with multiple valence states. Generally, metals with multiple valence states can be plated from most of their stable states. Since the charge required to deposit any metal is directly proportional to the electrons required for the reduction, metals in their valence states closest to their neutral states consume less energy for reduction to metal. Unfortunately, most metals in their state closest to their neutral states are inherently unstable, and therefore production-worthy plating can be unfeasible. Through the use of processes for plating metal ions described above, plating solutions that include metals in this inherently unstable state can be applied in an effective process to deposit the desired metal. Through the use of the processes described above for depositing a metal, less oxidation of the inherently unstable metal species occurs, thus providing a more production-worthy process.

By way of illustration, most tin-silver plating solutions prefer Sn(II) as the species for tin plating. For such multi-component plating systems, control of tin and silver ions needs to be precise. Multi-component plating systems can use inert or consumable anodes. The use of consumable anodes could cause stability issues resulting from plating/reacting of one of the metals with the anodes, and they also create issues relating to the ability to uniformly replenish metal. On the other hand, the use of inert anodes avoids the foregoing issues, but introduces a new issue associated with the production of oxygen through the oxidation of water or hydroxyl ions at the inert anode. Such oxygen not only may oxidize other components in the plating bath, it may also oxidize the desired species, e.g., Sn(II) to the more stable species, e.g., Sn(IV) ion, which is more difficult to plate onto a workpiece.

Figure 6:
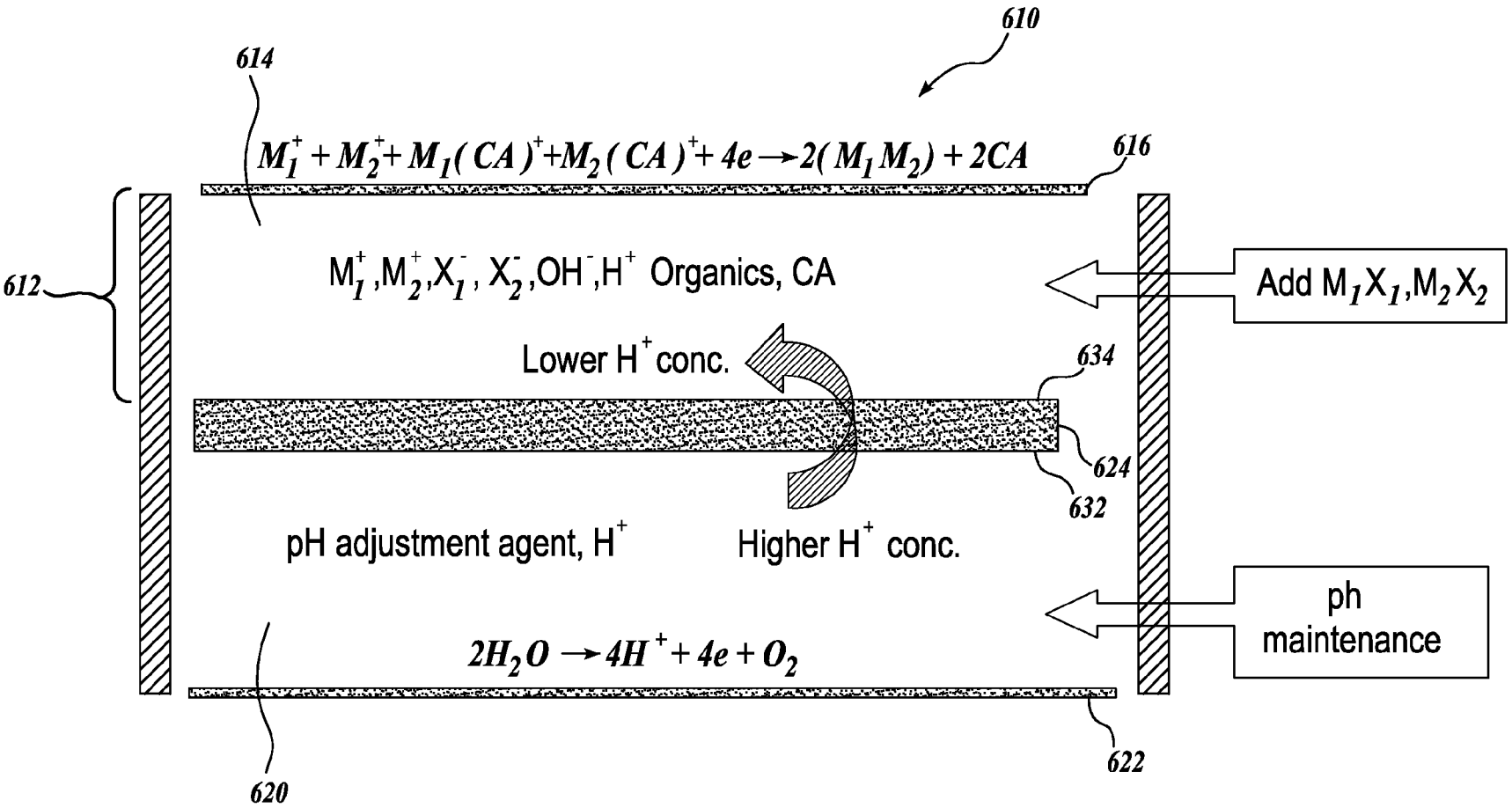
FIG. 6 is a schematic illustration of the chemistry and chemical reactions occurring in one embodiment of the processes for electroplating two metals described herein using an inert anode.

Referring to FIG. 6, a schematic illustration is provided for the operation of reactor 610 using a cation permeable barrier 624 and an inert anode 622 in combination with a first processing fluid 614 and a second processing fluid 620 suitable for depositing tin-silver solder. In the description that follows, processing fluid 614 in processing unit 612 is a catholyte containing metal ions $M_1^+$ and $M_2^+$, e.g., $Sn^{2+}$ and $Ag^+$ ions; counter ions $X_1^-$ and $X_2^-$ for the metal ions, e.g., methane sulfonate $CH_3SO_3^-$; and complexing agents $CA_1$ and $CA_2$, e.g., proprietary organic additives, chelated with the metal ions, hydrogen ions and hydroxyl ions. As discussed above in the context of the electroplating of copper, the specific hydrogen ion concentration in catholyte 614 can be chosen taking into consideration conventional factors such as complexing ability of the complexing agent, buffering capability of the buffer, metal ion concentrations, volatile organics concentrations, alloy deposition potential of the complex at the particular pH, solubility of the catholyte constituents, stability of the catholyte, desired characteristics of the deposits, and diffusion coefficients of the metal ions.

The discussions above regarding the concentration of $H^+$ in the anolyte and catholyte, relative concentrations of the buffer in the anolyte and the catholyte, use of the pH adjustment agent, replenishment of the metal ions, cathodic reduction reactions, and anodic oxidation reactions in the context of the electroplating of copper are equally applicable to a tin-silver system. The particular operating conditions that are most desirable are related to the specific chemistry being used.

As with the copper plating process, an electric potential applied between cathode 616 and anode 622 results in tin ions and silver ions being reduced at cathode 616 and deposited thereon. The hydrogen ion ($H^+$) accumulates in the anolyte near a first surface 632 of cation permeable barrier 624. As with the copper system, at positively charged inert anode 622, water is converted to hydrogen ions ($H^+$) and oxygen. The resulting electrical charge gradient urges positively charged hydrogen ions ($H^+$) to move from first surface 632 of cation permeable barrier 624 to the second surface 634 of cation permeable barrier 624. The transfer of positively charged hydrogen ions from anolyte 620 to catholyte 614 during the plating cycle maintains the charge balance of reactor 610. As noted in FIG. 6, the concentration of hydrogen ion in anolyte 620 is higher than the concentration of hydrogen ion in catholyte 614. This concentration gradient also urges hydrogen ions to transfer from anolyte 620 to catholyte 614 through cation permeable barrier 624. Tin and silver ions that are deposited onto cathode 616 can be replenished by the addition of a solution of tin methane sulfonate and silver methane sulfonate to the catholyte. During the plating cycle, MSA ions that are introduced to catholyte 614 as a result of the addition of the tin MSA and silver MSA build up and must eventually be removed. Portions of the catholyte can be removed from processing unit 612 to address the buildup of MSA ions in the catholyte.

Alternatively, the tin and/or silver ions could be added to anolyte 620 under conditions wherein the hydrogen ion concentration in the catholyte 614 is greater than the hydrogen ion concentration of anolyte 620. Under these conditions, movement of hydrogen ions from anolyte 620 to catholyte 614 is inhibited by the hydrogen ion concentration gradient and the metal ions in the anolyte transfer to the catholyte and contribute to maintaining the charge balance of the reactor. Under these conditions, steps can be taken to mitigate any issues created by metal ions oxidizing in anolyte 620.

Figure 7:
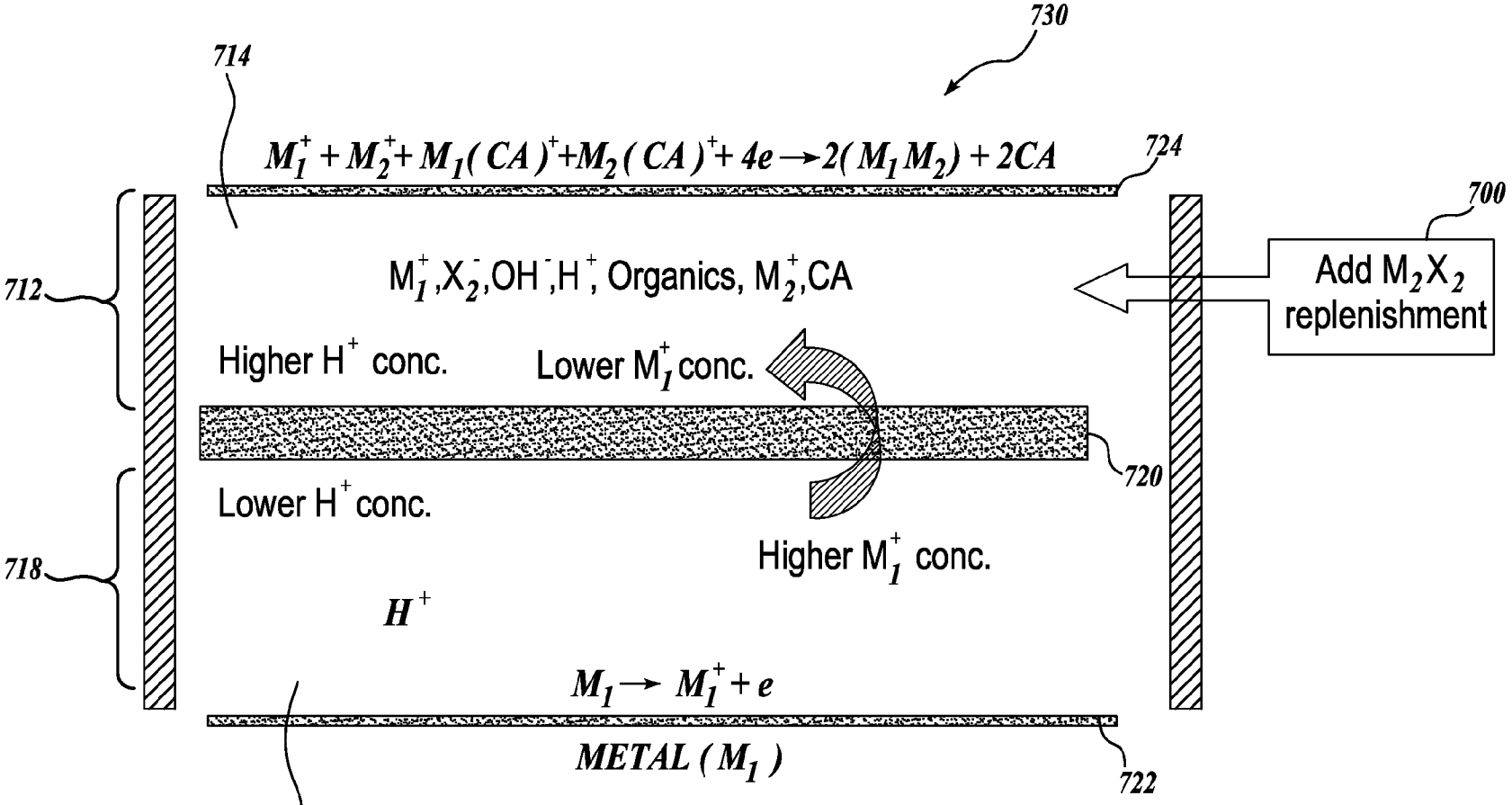
FIG. 7 is a schematic illustration of the chemistry and chemical reactions occurring in one embodiment of the processes for electroplating two metals described herein using a consumable anode.

Referring to FIG. 7, in a different embodiment, electroplating of two metals, e.g., tin and silver, can also be achieved using a consumable anode 722. Referring to FIG. 7, the catholyte 714 in processing unit 712 is similar to the catholyte described with reference to FIG. 6. In the process depicted in FIG. 7, metal ion $M_2^+$ is introduced into processing unit 712 from source 700, metal ion $M_1^+$ is supplied to counter electrode unit 718 through oxidation of metal making up consumable anode 722. Metal ion $M_1^+$ in anolyte 716 moves across cation permeable barrier 720 into catholyte 714. Movement of metal ion $M_1^+$ helps to maintain the charge balance of reactor 730. In addition, movement of metal ion $M_1^+$ from anolyte 716 to catholyte 714 is also promoted by a metal ion $M_1^+$ concentration gradient between anolyte 716 and 714, i.e., metal ion $M_1^+$ concentration in anolyte 716 is greater than the metal ion $M_1^+$ concentration in catholyte 714. Metal ions $M_1^+$ and $M_2^+$ can be reduced at cathode 724 and deposited thereon as described above with reference to FIG. 6. In accordance with this embodiment, complexing agents (CA) are present in catholyte 714 where they can complex with metal ions $M_1^+$ and $M_2^+$. Suitable pH adjustment agents and pH buffers may be present and/or added to the catholyte and anolyte. The charge balance within reactor 730 can be maintained through the transfer of positively charged metal ion $M_1^+$ in counter-electrode unit 718 across cation permeable membrane 720 into processing unit 712. In this system, movement of hydrogen ions from anolyte 716 to catholyte 714 in order to provide charge balance is inhibited (in favor of transfer of $M_1^+$) by providing a higher concentration of hydrogen ion in catholyte 714 than in anolyte 716. In such a system, metal ion $M_2^+$ does not come into contact with anode 722 where it may undesirably deposit depending upon the deposition potentials of metal ion $M_2^+$ and metal ion $M_1^+$.

It is contemplated that cations in addition to metal ion $M_1^+$ could pass through cation permeable barrier 720 from anolyte 716 to catholyte 714, for example by reversing the hydrogen ion concentration gradient described above. When the hydrogen ion concentration gradient is reversed, e.g., the hydrogen ion concentration of the anolyte is greater than the hydrogen ion concentration of the catholyte, hydrogen ions will more readily transfer from anolyte 716 to catholyte 714. In addition, it is contemplated that other metal ions in addition to $M_1^+$ could be added to anolyte 716 and transfer from anolyte 716 to catholyte 714 through cation permeable barrier 720.

Suitable reactors for depositing tin ions and silver ions includes one designated a Raptor™ by Semitool, Inc., of Kalispell, Mont., or a reactor of the type described in U.S. Patent Application Ser. No. 60/739,343, filed on Nov. 23, 2005, entitled Apparatus and Method for Agitating Fluids and the Processing of Microfeature Workpieces.

Figure 10:
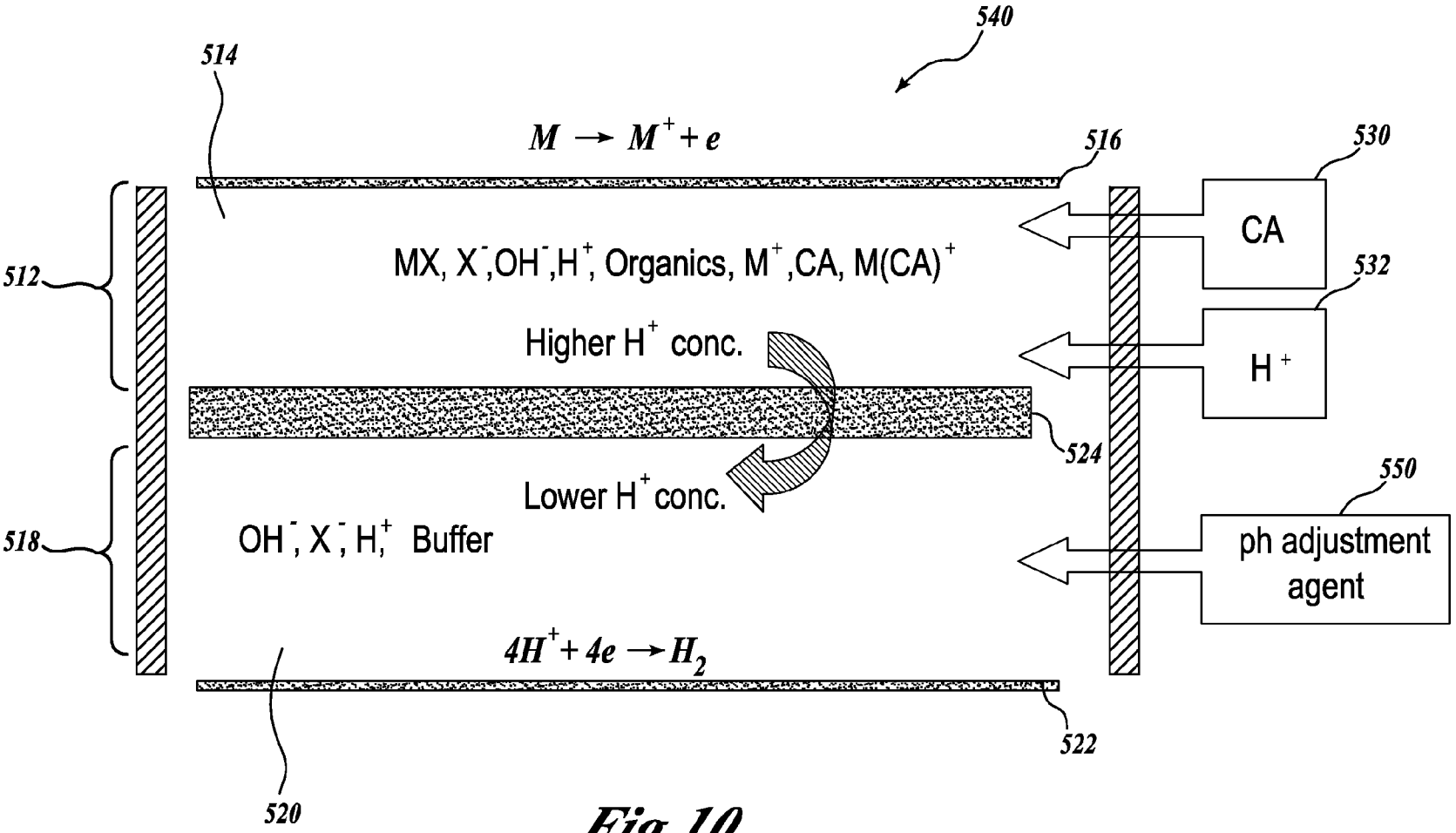
FIG. 10 is a schematic illustration of the chemistry and chemical reactions occurring in one embodiment of the processes for deplating a metal described herein.

Metal can be deplated from a microfeature workpiece by reversing the bias of the electric field created between the microfeature workpiece and the working electrode. Referring to FIG. 10, a microfeature workpiece 516 is provided that carries a metal M, e.g., copper, on its surface. Microfeature workpiece 516 is contacted with a first processing fluid 514 in processing unit 512. Processing fluid 514 includes metal ions $M^+$, e.g., copper ions; a complexing agent CA, e.g., ethylene diamine tetraacetic acid; a metal salt MX, e.g., copper sulfate or copper phosphate; a complexed metal ion $M(CA)^+$; hydroxyl ions; a buffer, and a counter ion $X^-$, e.g., phosphate or sulfate ion. Processing unit 512 is separated from a counter electrode unit 518 by cation permeable membrane 524. Counter electrode unit 518 includes counter electrode 522 and a second processing fluid 520. In a deplating process, microfeature workpiece 516, the working electrode, is an anode, and counter electrode 522 is the cathode. Processing unit 512 is also in fluid communication with a source 530 of complexing agent CA and a source 532 of hydrogen ions. Counter electrode unit 518 is in fluid communication with a source 550 of pH adjustment agent. Through the application of an electric potential between anode 516 and cathode 522, hydrogen ions are reduced at the cathode 522 to produce hydrogen gas. Metal on the surface of microfeature workpiece 516 is oxidized resulting in metal ions being removed from the surface of the microfeature workpiece. The charge balance within reactor 540 is maintained through the transfer of hydrogen ions from catholyte 520 to anolyte 514 through cation permeable membrane 524.

Catholyte 520 in counter electrode unit 518 includes hydrogen ions, hydroxyl ions, buffer, and counter ion $X^-$. The pH adjustment agent that is added to counter electrode unit 518 can be both a source of counter ion $X^-$ as well as hydrogen ions ($H^+$). Over time, metal ion $M^+$ builds up in concentration in anolyte 514. Accordingly, periodic purging and replenishing of anolyte 514 may be necessary. Charge balance within reactor 540 is maintained by transfer of hydrogen ions from anolyte 514 to catholyte 520. To further promote movement of hydrogen ions from anolyte 514 through cation permeable barrier 524 to catholyte 520, a hydrogen ion concentration gradient can be established between anolyte 514 and catholyte 520. In other words, the concentration of hydrogen ions in anolyte 514 can be greater than the concentration of hydrogen ions in catholyte 520. While it is possible for metal ion $M^+$ to also transfer from anolyte 514 to catholyte 520, it is preferred that the charge balance be maintained primarily through movement of hydrogen ions as opposed to metal ions. If it is desired to have the metal ion serve as the major charge carrier to maintain charge balance within reactor 540, movement of hydrogen ions across cation permeable barrier 524 can be inhibited by reversing the hydrogen ion concentration, i.e., hydrogen ion concentration of the catholyte is greater than the hydrogen ion concentration of the anolyte.

Figure 8:
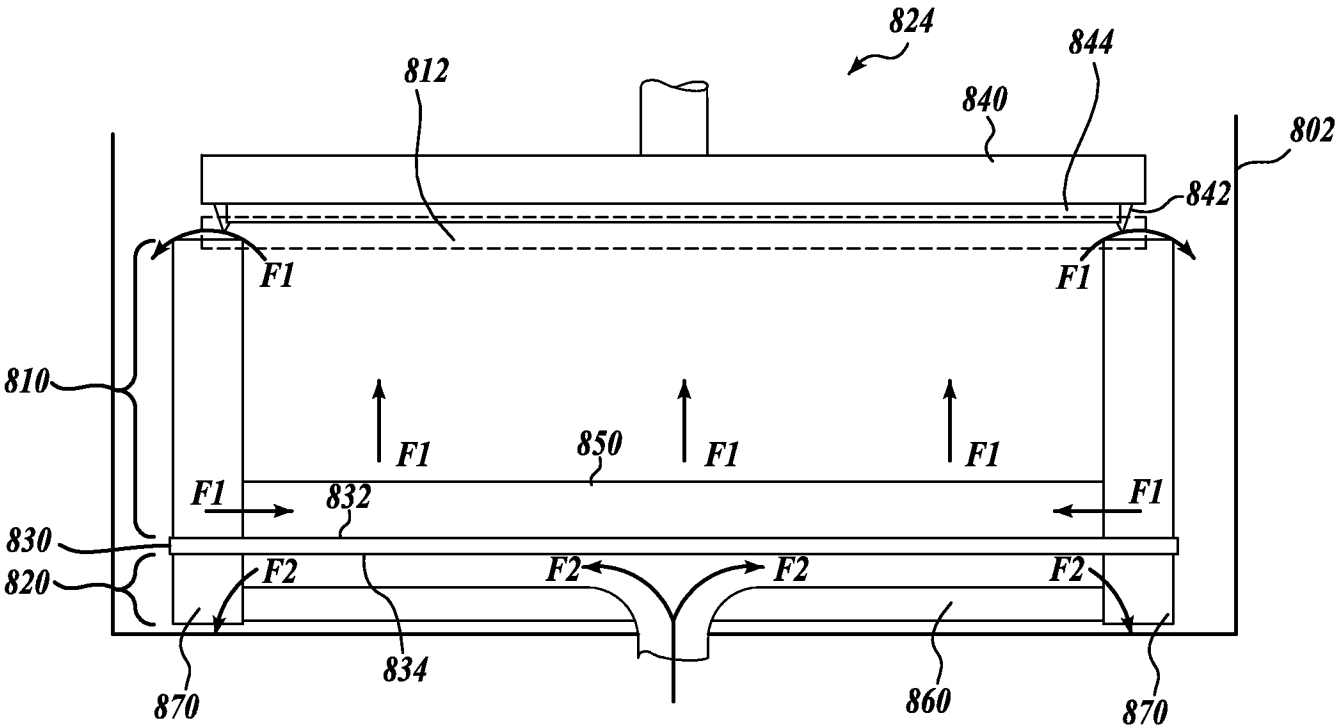
FIG. 8 is a schematic illustration of a reactor for carrying out processes described herein.

Referring to FIG. 8, a more detailed schematic illustration of one design of a reactor 8 for directly electroplating metal onto barrier layers or otherwise depositing materials onto workpieces using a cation permeable barrier is illustrated. Reactor 824 includes a vessel 802, a processing chamber 810 configured to direct a flow of first processing fluid to a processing zone 812, and an anode chamber 820 configured to contain a second processing fluid separate from the first processing fluid. A cation permeable barrier 830 separates the first processing fluid in the processing unit 810 from the second processing fluid in the anode chamber 820. Reactor 820 further includes a workpiece holder 840 having a plurality of electrical contacts 842 for applying an electric potential to a workpiece 844 mounted to workpiece holder 840. Workpiece holder 840 can be a movable head configured to position workpiece 844 in processing zone 812 of processing unit 810, and workpiece holder 840 can be configured to rotate workpiece 844 in processing zone 812. Suitable workpiece holders are described in U.S. Pat. Nos. 6,080,291; 6,527,925; 6,773,560, and U.S. patent application Ser. No. 10/497,460; all of which are incorporated herein by reference.

Reactor 824 further includes a support member 850 in the processing chamber 810 and a counter electrode 860 in the anode chamber 820. Support member 850 spaces the cation permeable barrier 830 apart from workpiece processing zone 812 by a controlled distance. This feature provides better control of the electric field at processing zone 812 because the distance between the cation permeable barrier 830 and workpiece processing zone 812 affects the field strength at processing zone 812. Support member 850 generally contacts first surface 832 of cation permeable barrier 830 such that the distance between first surface 832 and processing zone 812 is substantially the same across processing chamber 810. Another feature of support member 850 is that it also shapes cation permeable barrier 830 so that bubbles do not collect along a second side 834 of cation permeable barrier 830.

Support member 850 is configured to direct flow $F_1$ of a first processing fluid laterally across first surface 832 of cation permeable barrier 830 and vertically to processing zone 812. Support member 850 accordingly controls the flow $F_1$ of the first processing fluid in processing chamber 810 to provide the desired mass transfer characteristics in processing zone 812. Support member 850 also shapes the electric field in processing chamber 810.

Counter electrode 860 is spaced apart from second surface 834 of cation permeable barrier 830 such that a flow $F_2$ of the second processing fluid moves regularly outward across second surface 834 of cation permeable barrier 830 at a relatively high velocity. Flow $F_2$ of the second processing fluid sweeps oxygen bubbles and/or particles from the cation permeable barrier 830. Reactor 824 further includes flow restrictor 870 around counter electrode 860. Flow restrictor 870 is a porous material that creates a back pressure in anode chamber 820 to provide a uniform flow between counter electrode 860 and second surface 834 of the cation permeable barrier 830. As a result, the electric field can be consistently maintained because flow restrictor 870 mitigates velocity gradients in the second processing fluid where bubbles and/or particles can collect. The configuration of counter electrode 860 and flow restrictor 870 also maintains a pressure in the anode chamber 820 during plating that presses the cation permeable barrier 830 against support member 850 to impart the desired contour to cation permeable barrier 830.

Reactor 824 operates by positioning workpiece 844 in processing zone 812, directing flow $F_1$ of the first processing fluid through processing chamber 810, and directing the flow $F_2$ of the second processing fluid through anode chamber 820. As the first and second processing fluids flow through reactor 824, an electric potential is applied to workpiece 844 via electrical contacts 842 and counter electrode 860 to establish an electric field in processing chamber 810 and anode chamber 820.

Another useful reactor for depositing metals using processes described herein is described in U.S. Patent Application No. 2005/0087439, which is expressly incorporated herein by reference.

Figure 9:
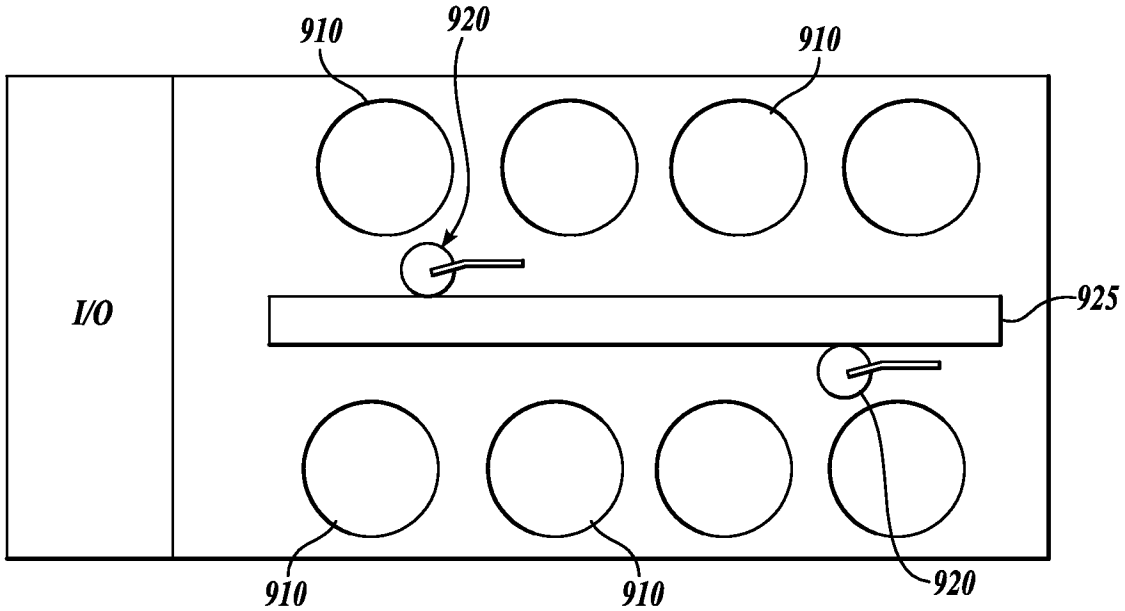
FIG. 9 is a schematic illustration of a tool that includes chambers for carrying out processes described herein.

One or more of the reactors for electrolytically treating a microfeature workpiece or systems including such reactors may be integrated into a processing tool that is capable of executing a plurality of methods on a workpiece. One such processing tool is an electroplating apparatus available from Semitool, Inc., of Kalispell, Mont. Referring to FIG. 9, such a processing tool may include a plurality of processing stations 910, one or more of which may be designed to carry out an electrolytic processing of a microfeature workpiece as described above. Other suitable processing stations include one or more rinsing/drying stations and other stations for carrying out wet chemical processing. The tool also includes a robotic member 920 that is carried on a central track 925 for delivering workpieces from an input/output location to the various processing stations.

While a preferred embodiment of the invention has been illustrated and described, it will be appreciated that various changes can be made therein without departing from the spirit and scope of the invention.

The embodiments of the invention in which an exclusive property or privilege is claimed are defined as follows:

1. A process for electrolytically processing a microfeature workpiece as the working electrode with a first processing fluid and a counter electrode, comprising:

providing a microfeature workpiece comprising a nonmetallic substrate having a dielectric layer disposed over a substrate and a continuous metal feature disposed on the dielectric layer and having microfeatures comprising recessed structures;

contacting a surface of the microfeature workpiece with the first processing fluid, the first processing fluid comprising first processing fluid species including at least one metal cation, an anion, and a complexing agent;

contacting the counter electrode with a second processing fluid;

producing an electrochemical reaction at the counter electrode;

electrolytically depositing the metal cation onto the surface of the microfeature workpiece;

substantially preventing movement of anionic and complexing agent species between the first processing fluid and the second processing fluid; and depositing the at least one metal cation as metal into the recessed structures on the surface of the microfeature workpiece.

2. The process of claim 1, wherein the step of substantially preventing movement of anionic species between the first processing fluid and the second processing fluid comprises providing a cation permeable barrier between the first processing fluid and the second processing fluid.

3. The process of claim 2, wherein the cation permeable barrier is a cation exchange membrane.

4. The process of claim 1, wherein the working electrode is a cathode, and the counter electrode is an anode.

5. The process of claim 4, wherein the first processing fluid further comprises hydrogen ion and the hydrogen ion passes between the first processing fluid and the second processing fluid through the cation exchange membrane.

6. The process of claim 1, wherein the metal cation concentration in the first processing fluid is in the range of 0.03 to 0.25 M.

7. The process of claim 1, further comprising substantially preventing the formation of an oxidizing agent at the counter electrode.

8. The process of claim 1, further comprising preventing gases generated at the counter electrode from passing into the first processing fluid.

9. The process of claim 1, wherein the ratio between the concentration of the at least one metal cation and the concentration of the complexing agent is in the range from 1:25 to 25:1.

10. The process of claim 1, wherein the first processing fluid further includes a buffering agent having a concentration in the range of about 0.0001 M to about 0.5 M.

11. The process of claim 1, wherein the pH of the first processing fluid is in the range of about 7 to about 13.

12. The process of claim 1, wherein the pH of the first processing fluid is less than 7.0.

13. The process of claim 1, wherein the at least one cation is selected from the group consisting of copper ion, lead ion, gold ion, tin ion, silver ion, platinum ion, ruthenium ion, rhodium ion, iridium ion, osmium ion, rhenium ion, palladium ion, and nickel ion.

14. A process for electrolytically processing a microfeature workpiece as the working electrode with a first processing fluid and a counter electrode, comprising:

providing a microfeature workpiece comprising a nonmetallic substrate having a dielectric layer disposed over a substrate and a continuous metal feature disposed on the dielectric layer and having microfeatures comprising recessed structures;

contacting a surface of the microfeature workpiece with the first processing fluid, the first processing fluid comprising first processing fluid species including at least one metal cation, an anion, and at least one organic component selected from the group consisting of accerators, suppressors, and levelers;

contacting the counter electrode with a second processing fluid;

producing an electrochemical reaction at the counter electrode;

electrolytically depositing the metal cation onto the surface of the microfeature workpiece;

providing a cation exchange membrane to substantially prevent movement of anionic species and the at least one organic component between the first processing fluid and the second processing fluid; and depositing the at least one metal cation as metal into the recessed structures on the surface of the microfeature workpiece.

15. A process for electrolytically processing a microfeature workpiece as the working electrode with a first processing fluid and a counter electrode, comprising:

contacting a surface of the microfeature workpiece with the first processing fluid, the first processing fluid comprising first processing fluid species including a metal cation, an anion, and a complexing agent;

contacting the counter electrode with a second processing fluid;

producing an electrochemical reaction at the counter electrode;

electrolytically depositing the metal cation onto the surface of the microfeature workpiece;

providing a cation permeable barrier between the first processing fluid and the second processing fluid to substantially prevent the movement of anionic and complexing agent species between the first processing fluid and the second processing fluid; and depositing the metal cation as metal into recessed structures on the surface of the microfeature workpiece, and removing metal from the surface of the microfeature workpiece to form a microelectronic circuit.

* * * * *